United States Patent [19]

Vanden Bergh

[11] 4,374,691

[45] Feb. 22, 1983

[54] MATERIAL AND METHOD FOR FORMING PRESSURE TRANSFERABLE GRAPHICS

[75] Inventor: Jan D. Vanden Bergh, Afton, Minn.

[73] Assignee: Minnesota Mining and Manufacturing Company, St. Paul, Minn.

[21] Appl. No.: 148,452

[22] Filed: May 9, 1980

[51] Int. Cl.[3] ..... B41M 3/12; B41M 5/26; B44C 1/16

[52] U.S. Cl. ..... 156/234; 428/343; 428/345; 428/354; 428/488; 428/913; 428/914; 430/11; 430/14; 430/18; 430/200; 101/467; 101/470; 156/235; 156/240; 156/241; 156/247; 156/249; 156/275.1; 250/316.1; 427/146; 427/198; 427/271; 428/143; 428/147; 428/206; 428/207; 428/304.4; 428/317.1; 428/321.1; 428/321.3

[58] Field of Search ..... 156/234, 230, 235, 238, 156/239-241, 247, 249, 256, 275.1, 277; 428/306-308, 320, 322, 343, 345, 347-349, 354, 355, 913, 914, 143, 147, 195, 200, 206, 207, 304.4, 315.5, 317.1, 317.3, 318.4, 320.2, 321.1, 321.3, 323, 327; 101/467, 470, 473; 250/316.1, 317.1, 318; 427/146-148, 152, 180, 198, 271; 430/9, 11, 14, 18, 200, 348

[56] References Cited

U.S. PATENT DOCUMENTS 4,123,309 10/1978 Perrington et al. ..... 156/234
4,157,412 6/1979 Deneau ..... 428/147

*Primary Examiner*—Bruce H. Hess
*Attorney, Agent, or Firm*—Cruzan Alexander; Donald M. Sell; William L. Huebsch

[57] ABSTRACT

A composite material and method for forming graphics such as letters or numbers that are pressure transferable to a substrate. The composite material includes an accepting tape including a layer of latent adhesive material on a receiving web, and a friable slightly adhesive layer lightly adhered to a donor web. When the layers are pressed together and the composite material is selectively heated in graphic patterns, corresponding portions of the adhesive material and friable layer adhere together so that upon subsequent separation of the layer of adhesive and the donor web portions of the friable layer transfer to the accepting tape in the heated areas to provide graphics. When the graphics are then positioned against a substrate and are pressed against the substrate by rubbing pressure applied through the receiving web, the adhesive layer will tear around the graphic and separate from the receiving web over the graphic so that the graphic will be transferred to the substrate.

9 Claims, 5 Drawing Figures

MATERIAL AND METHOD FOR FORMING PRESSURE TRANSFERABLE GRAPHICS

This invention relates to composite materials and methods used in forming graphics such as letters, numbers, symbols and pictures which may be transferred to a substrate.

One system is known in which graphics are formed by causing a layer of adhesive material to selectively adhere to a frangible doner layer of microgranules by selectively heating the adhesive in graphic patterns so that upon separation of the layers, graphics will be formed by transfer of portions of the frangible doner layer to the adhesive layer, and the graphics can subsequently be transferred to a substrate. This system is described in U.S. Pat. No. 4,123,309 assigned to the assignee of this application, the content whereof is incorporated herein by reference.

Briefly, in that system graphics are formed along a composite strip material comprising (1) an accepting portion or tape comprising a receiving web carrying a layer of latent adhesive material and (2) a transfer portion or tape comprising a doner web carrying a lightly adhered doner layer of microgranules in face-to-face contact with the layer of adhesive material. At least one of the layers bears a radiation-absorbing pigment, and the strip material is essentially transparent to radiant energy between one exterior surface and the pigment so that the pigment may be exposed to heat-producing radiation by devices such as those described in U.S. Pat. No. 3,828,359, and U.S. patent application Ser. No. 104,575, the contents whereof are also incorporated herein by reference. Upon momentary exposure to a pattern of radiation, the pigment is selectively heated and momentarily softens the adjacent portions of the layer of adhesive material which, upon solidification, visibly adhere to the doner layer. After a series of such exposures have been made, the accepting tape and doner web are separated, transferring portions of the frangible doner layer to the accepting tape only in irradiated areas to provide the graphics. The graphics can be used on the accepting tape, or if the doner layer comprises a thermoplastic resin which acts as an adhesive upon softening, the graphics carried by the accepting tape can be adhered to a substrate by applicaton of sufficient heat through the accepting tape to soften the thermoplastic resin.

While that system can form graphics with such resolution that even half-tone photographs may be reproduced, the need for heat to transfer graphics to a substrate makes the system inconvenient to use.

SUMMARY OF THE INVENTION

The present invention provides a composite material which, like the composite material described above, also makes possible the production of graphics which are immediately visible to permit composing graphics along a strip of material. The graphics produced are of suitable quality for many applications such as on drawings, posters or visual transparencies, and can be transferred from an accepting tape on which they are formed to a substrate through the use of pressure alone, thus eliminating the need for the heat that was required to transfer graphics formed by the process described above.

Like the composite material described in U.S. Pat. No. 4,123,309, the composite material according to the present invention includes an accepting tape comprising a receiving web and layer of latent adhesive material adhered to the receiving web, which adhesive material is nontacky at normal room temperature, but is softened and activated when heated to a temperature range somewhat above normal room temperature; a doner web; and a frangible donor layer releasably adhered to the doner web and facing the layer of adhesive material so that when the composite is selectively heated, the doner layer will adhere to the adhesive layer in the heated areas and the adhered portions of the frangible doner layer will transfer to the accepting tape to provide grahics when the accepting tape and doner webs are separated.

Unlike that composite material, however, the frangible donor layer is somewhat adhesive and the layer of latent adhesive material is sufficiently weak and frangible that when the graphic shaped portions of the donor layer that transfer to the accepting tape are positioned against a substrate and pressed against the substrate by rubbing pressure applied to the outer surface of the accepting tape, the latent adhesive will tear around the graphics and separate from the accepting tape over the graphics so that the graphics will transfer and adhere to the substrate.

Like the doner layer described in U.S. Pat. No. 4,123,309, the frangible doner layer according to the present invention should be microgranular in nature to afford a separating line generally normal to the surface of the doner web, which separating line closely conforms to the periphery of an irradiated area so that the edge of the graphic will be clean and sharp.

Preferably the frangible doner layer comprises microgranules fused to each other having interstices containing pigment and liquid, which layer is formed by coating and drying a dispersion of noncompatible materials; one of which materials comprises a resin which upon drying forms the particles which are fused together, and the other of which materials remains liquid and is retained in the interstices between the particles together with any solid particles of pigment in the dispersion. The proportion of the material that remains liquid in the dispersion will affect the frangibility of the layer, with increased proportions of that material producing increased frangibility. A dispersion that can provide such coatings includes a solid ionomer dispersion of partially neutralized ethylene-acrylic acid copolymer which forms the microgranules, and a hexamethoxymethyl melamine which provides the liquid phase.

The frangible doner layer of microgranules should have sufficient thickness to provide the optical density or opaqueness required of the graphics to be formed for a particular application. The desired opacity may be provided by using opaque microgranules or by filling the interstices between the microgranules with a pigment such as the aforementioned radiation absorbing pigment, which may be provided by carbon black particles.

The frangible doner layer should be sufficiently adhesive at room temperature that it will adhere to a substrate such as paper, illustration board, glass or plastic films when rubbing pressure is applied to transfer the graphic from the accepting tape to the substrate, however, unimaged portions of the doner layer must not adhere to the adhesive layer when the accepting tape and donor web are separated. Such adhesive properties can be imparted to the doner layer by the addition of a vinyl acetate, ethylhexyl acrylate, diethylbenzyl maleate adhesive or tackifier ("Daratak" 74L) together with paraffin and polyethylene particles ("Michem" 39930) which provide a desired increased differential between the adhesion of heated and unheated areas of the doner layer to the doner web during the graphic forming process.

The adhesive layer should afford adequate adhesion to the frangible doner layer while still being thin so that radiant energy requirements to soften the adhesive material are minimized. The adhesive material should soften over a temperature range which is sufficiently above room temperature (e.g., above 60° C.) to permit shipping and storage without refrigeration. During the instantaneous softening of the adhesive material, it should wet and adhere to the doner layer. Additionally, the adhesive layer should fracture or tear around the graphics and separate from the accepting web over the graphics when rubbing pressure is applied through the accepting web to transfer the graphics to the substrate, and a visual indication should be provided to a user as the adhesive over the graphic releases from the accepting web, (such as a change in brilliance of the color of the graphic) so that the user can tell when the graphic is transferred. A preferred adhesive layer that provides this combination of properties is a thin layer of a brittle cresol novolac epoxy resin (e.g., "ECN 1299" available fom Ciba-Geigy of Ardsley, N.Y.).

This brittle resin will tear or fracture around the graphics and fracture at its bond to the donor web over a graphic as the rubbing pressure is applied to transfer the graphic to a substrate because the rubbing pressure flexes or stretches the donor web adjacent the graphic beyond the elastic limit of the adhesive layer. The layer should have a minimum thickness of about 0.0076 mm (0.0003 inch) which ensures that the resin will adhere to the microgranules to form graphics during exposure and will separate cleanly from the accepting tape when the graphics are transferred to a substrate; and should not be thicker than about 0.0163 mm (0.00065 inch) since thicker coatings tend to be less frangible than desired and produce rough edges around the portions of the adhesive layer that transfer with the graphics.

A workable, but less desirable adhesive layer in that it tends to readhere to the accepting tape during transfer so that the accepting tape must be peeled away at the same time the graphic is transferred to a substrate by rubbing pressure through the accepting web, is a friable adhesive layer comprising paraffin wax (e.g., "Shellwax" 100 and 200) which will soften at a relatively low temperature and wet the frangible donor layer during imaging, which wax is disposed in the interstices of a sponge-like structure of copolymers which provides cohesive strength in the layer and comprises polyethylene-methacrylic acid copolymer (e.g., "Polyeth" 70055 from Gulf Chemical) which additionally reduces the adhesion of the adhesive layer so that it will release from the graphics when they are transferred by rubbing, and ethylene-vinyl acetate copolymer (e.g., "Elvax" 460) which additionally provides adhesion of the adhesive layer to the accepting tape. This adhesive layer is coated from a solvent solution and dried at room temperature to cause the incompatible polymers to form the sponge-like structure prior to solidification of the wax and thereby maximize the frangibility of the adhesive layer.

The doner web and the accepting tape should have sufficient strength and dimensional stability over the temperature range to which the strip material is subjected to prevent distortion of the graphics, however, when the preferred brittle adhesive layer is used, the accepting tape should be locally deformable under pressure manually applied with a small tip of a stylus to transfer graphics so that the adhesive layer will be fractured over and around the graphics to effect their transfer to a substrate. Additionally, the donor web should provide low adhesion to the frangible donor layer, and the accepting tape should provide good adhesion to the solidified adhesive layer. A suitable material for both the donor web and the receiving web is biaxially oriented polyethylene terephthalate film of 0.04 mm (0.0015 inch) thickness.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
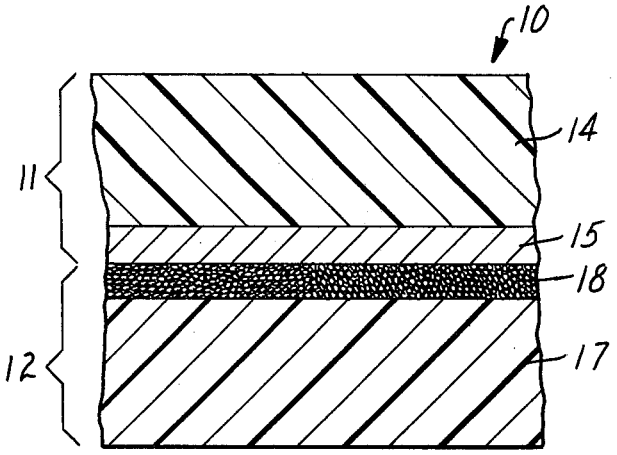
FIG. 1 is an enlarged fragmentary sectional view of the composite material according to the present invention.

FIG. 1 shows an embodiment of the composite strip material according to the present invention generally designated by the numeral 10, which composite strip material is adapted for use in composing dark-colored graphics. The strip material 10 consists of an accepting portion or tape 11 and a transfer portion or tape 12. The tapes 11 and 12 each include a coating which coatings are positioned in face-to-face relationship.

The accepting tape 11 consists of a strong deformable thermally stable receiving web 14 and a firmly adhered coating or layer of adhesive material 15 having a softening range above normal ambient or room temperature. Both the receiving web 14 and the adhesive material 15 are essentially transparent to radiation. The transfer tape 12 includes a strong thermally stable donor web 17 which is also essentially transparent to radiation, and a slightly adhesive frangible donor layer 18 of microgranules releasably adhered to the donor web 17. A radiation absorbing pigment such as carbon black is incorporated in the frangible donor layer 18 to give it a dark radiation absorbing color.

Figure 2:
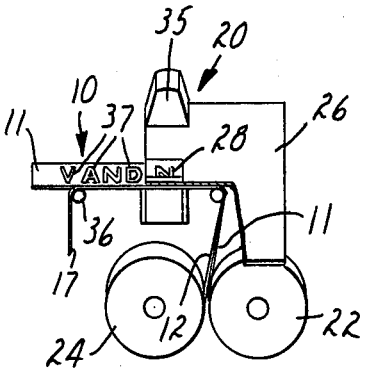
FIG. 2 is a schematic perspective view of a device for composing graphics along the composite material of FIG. 1.

FIG. 2 schematically illustrates a suitable device 20 for forming graphics along the strip material 10. The device 20 is similar to the devices more fully described in U.S. Pat. No. 3,914,775 and U.S. patent application Ser. No. 104,575, the disclosures whereof are incorporated herein by reference.

Briefly, the device 20 includes means for supporting reels 22 and 24 of tapes 11 and 12, respectively, and for guiding the tapes 11 and 12 along a path with the donor layer 18 and the layer of adhesive material 15 in face-to-face relationship to provide the composite material 10. An opaque template 26 is provided which has openings in an opaque layer (e.g., reflective metal layer) to provide a series of windows 28 in the shape of graphics to be formed. Any one of the windows 28 of the template 26 can be positioned over the strip material 10 with the window adjacent its receiving web 14 at a predetermined position along the path. A xenon flash lamp 35 can be activated to irradiate the strip material 10 through the aligned window 28, and thereby form a graphic on the strip material 10 corresponding to the window 28.

The device 20 also includes drive means (not shown) for advancing the strip material 10 along the path between exposures by the xenon flash lamp 35, so that graphics 37 may be formed seriatim along the strip material 10.

Upon exposure, the exposed portions of the donor layer 18 are heated and in turn soften the adjacent portions of the adhesive layer 15 so that the adhesive layer 15 wets and adheres to the frangible donor layer 18 in the exposed areas.

Figure 3:
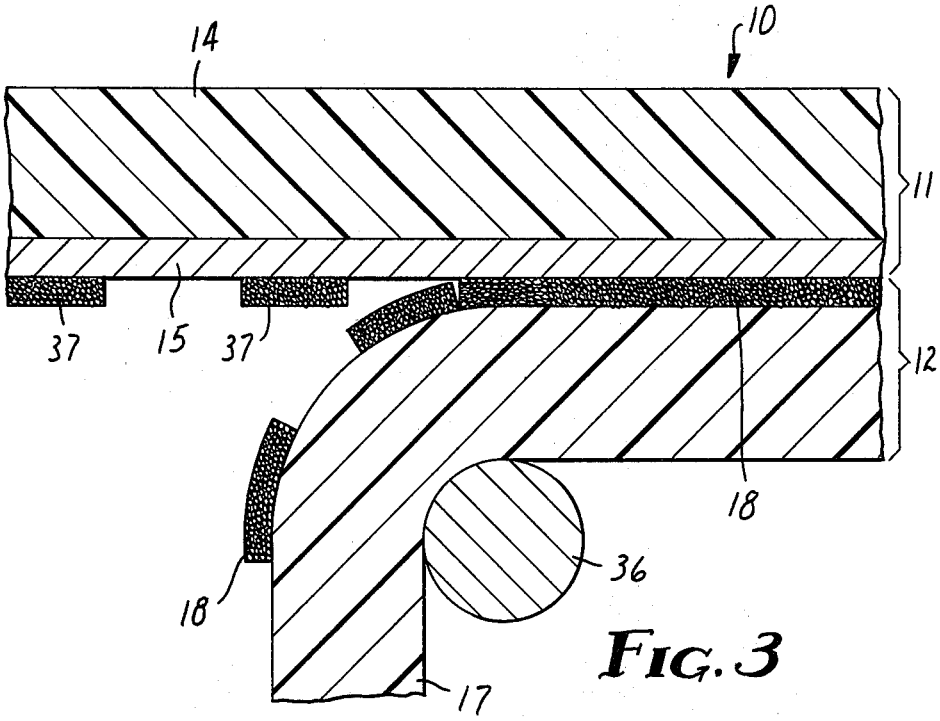
FIG. 3 is a fragmentary sectional schematic view of the composite strip material of FIG. 1 having graphics formed thereon and partially separated to show the transfer of granules from a donor web to a receiving web.

Subsequent to exposure, the donor and receiving webs 17 and 14 of the strip material 10 are sharply separated by pulling the donor web 17 around a small (i.e., less than ⅛ inch) diameter roller 36 while causing the accepting tape 11 to continue in a straight line path. As is illustrated in FIG. 3, this form of separation (which was not included in the devices described in U.S. Pat. No. 3,914,775 or U.S. patent application Ser. No. 104,575) causes portions of the frangible donor layer 18 to adhere to that portion of the layer of adhesive material 15 which was softened upon exposure by the xenon flash lamp 35 and transfer to the accepting tape 11 in accordance with the pattern of received radiation. Such transfer provides sharply defined graphics 37 on the accepting tape 11.

The strip material 10 is preferably exposed through the receiving web 14 to form graphics that may be read through the receiving web 14, but also could be exposed through the donor web 17 to form grahics that could be read on the exposed surface of the adhesive layer 15 after the accepting tape 11 is separated from the transfer tape 12.

Figure 4:
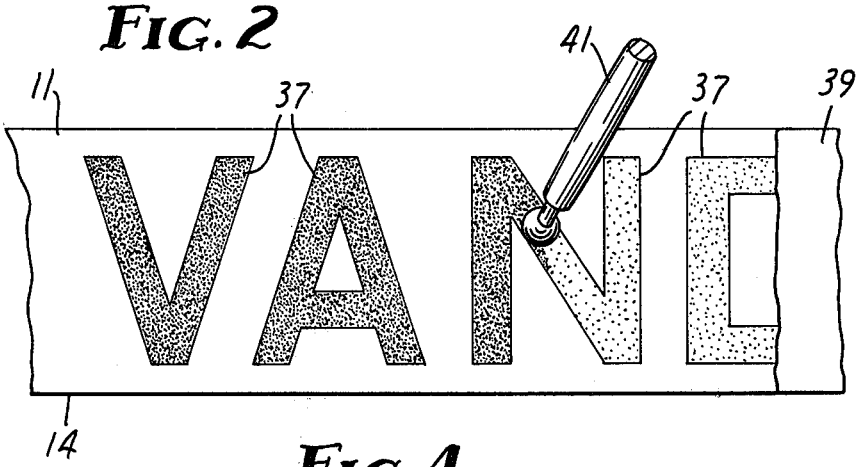
FIG. 4 is a top view of the separated receiving web of FIG. 3 illustrating the use of pressure to transfer of graphics from the receiving web to a substrate.
Figure 5:
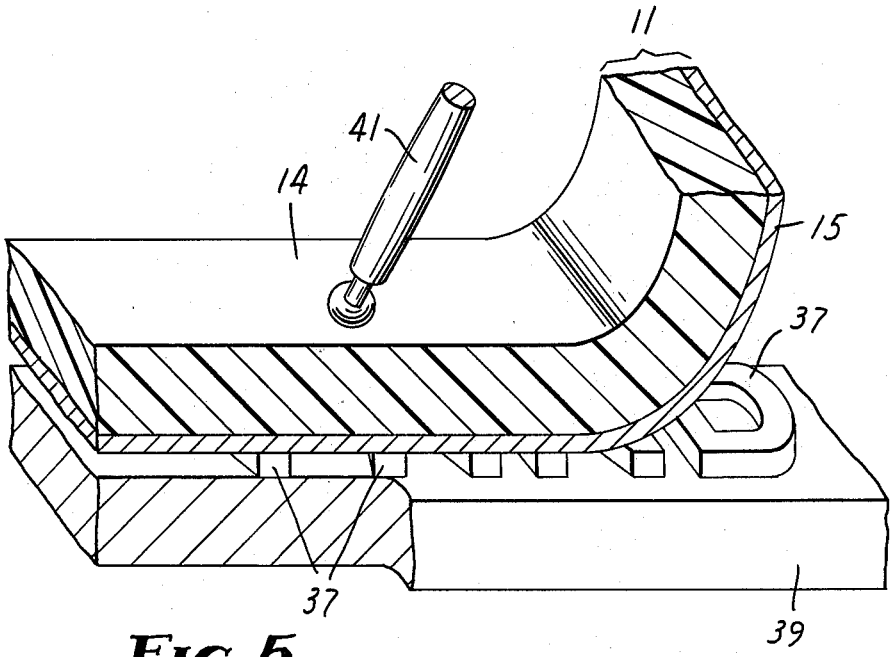
FIG. 5 is a fragmentary perspective view of the receiving web and substrate shown in FIG. 4 illustrating separation of the receiving web during the transfer of graphics.

The graphics 37 exposed on the accepting tape 11 may be adhered to a substrate by the application of pressure alone. As illustrated in FIGS. 4 and 5, the graphics 37 are positioned adjacent a substrate 39 (which, for example, may be paper, illustration board, glass or plastic film) and are transferred by the application of rubbing pressure applied against the outer surface of the receiving web 14 opposite the graphics 37 as by the spherical end of a stylus 41. The pressure of the stylus 41 slightly stretches the receiving web 14 over the graphics 37, thereby tearing the adhesive material 15 around the graphics 37 and separating the adhesive over the graphics 37 from the receiving web 14, which separation is evidenced by a change or decrease in the reflectivity or brilliance of the graphics 37 (called "greying out" in the art) as viewed through the receiving web 14 (FIG. 4), and adheres the graphics 37 to the substrate 39.

The present invention will be better understood with reference to the following nonlimiting examples wherein all parts are by weight unless otherwise specified.

EXAMPLE 1

An accepting portion 11 of the strip material 10 as shown in FIG. 1 was prepared by mixing equal parts by weight of cresol novolac epoxy resin (ECN 1299 from Ciba-Geigy) and methylethyl ketone, and roll coating the resulting solution onto a 0.04 mm (0.0015 inch) thick receiving web 14 of clear untreated biaxially oriented polyester via a knurled Rotogravure type roller to produce an average dry thickness for the adhesive material 15 of about 0.0113 micrometer (0.00045 inch).

The frangible donor layer 18 for the transfer portion 12 of the strip material 10 was prepared by diluting 20 parts of tackifier emulsion ("Daratak" 74L from W. R. Grace Co.) with 10 parts of water. While stirring, the mixture was adjusted to pH 9 by adding $NH_4OH$, and then had sequentially added to it 50 parts of a binder dispersion (e.g., "Surlyn-Two" 56230 from DuPont), 57 parts of an adhesion modifier dispersion (e.g., "Michem" 39930 from Michelman Chemicals Inc.), 20 parts of hexamethoxymethyl melamine (e.g., "Cymel" 301 from American Cyanamid) to produce frangibility, and 51 parts carbon emulsion (e.g. "Vulcan" XC-72 from Cabot) to act as a radiation absorber.

The resultant mixture was then coated onto a 0.04 mm (0.0015 inch) thick donor web 17 of clear polyester film with a knife coater set to produce an average thickness for the friable layer 18 of about 6 micrometers.

The two coated materials were then each slit into 2.5 cm (1 inch) wide strips. The donor and adhesive layers 18 and 15 on the slit strips were then placed in face-to-face contact. The composite material 10 thus formed was then selectively irradiated generally in accordance with the method described in Example 1 of U.S. Pat. No. 4,123,309. When the donor and receiving webs 17 and 14 were separated subsequent to exposure by pulling the donor web 17 around a small diameter roller while causing the accepting tape to continue in a straight line path, the entire thickness of the frangible donor layer 18 in the irradiated areas of the strip material 10 transferred to the layer of adhesive material 15 on the receiving web 14.

Graphics 37 formed on the accepting tape 11 were easily transferred to a fibrous substrate such as paper, illustration board, glass or plastic film by positioning the graphics 37 adjacent the substrate and applying rubbing pressure to the surface of the receiving web 17 opposite the graphic with a stylus having a spherical tip with a diameter of about 1/16 inch. The light reflectivity or brilliance of the graphics as viewed through the receiving web 14 visibly decreased so that the graphics appeared grey as the rubbing pressure was applied, indicating when the adhesive layer 15 over the graphic had fractured and released from the receiving web 14. The receiving web 14 was then lifted off the transferred graphics 37, carrying with it the adhesive layer 15 except in the areas from which the graphics 37 had been transferred where the adhesive layer 15 was missing. The missing portions of the adhesive layer were visibly apparent on and around the transferred graphics 37 as a shiny surface that could be made to lose at least part of its luster by brushing over the graphics with the tip of a finger. The transferred graphics 37 had sharp, clean edges and were firmly adhered to the substrate so that the substrate could be handled like normal printed matter without releasing the graphics 37.

A measurement of the brittleness of the adhesive material 15 on the receiving web 14 was made using the American National Standard ANSI PH 1.31-1971 test entitled "Method for Determining Brittleness of Photographic Film" the specifications whereon are incorporated herein by reference. Briefly, in that test one end of a length of the material to be tested is anchored on a first planar surface with the free end of the length of material extending in a first direction and the material is bent back over itself into a loop and positioned under a second planar surface which diverges from the first surface in said first direction. The loop is pulled via its free end into the narrowing space between the first and second surfaces until a crack appears in the material, whereupon the material is again straightened along the first surface and a number is read adjacent the crack in the material from calibrations along the first surface, which number is an indication of the diameter of the loop when the cracks first occurred that can be used to compare the brittleness of the material to the brittleness of other materials tested. When the adhesive material 15 described in this example was coated at least 0.0080 mm (0.00030 inch) thick on 0.04 mm (0.0015 inch) polyester film and tested as described above with the adhesive material on the outside of the loop, cracking occurred during the test; with 0.0080 mm (0.00030 inch) coatings of the adhesive being cracked at a 0.41 cm (0.16 inch) wedge opening, and coating 0.0085 mm (0.00032 inch) thick or over (e.g., a 0.0139 mm (0.00052 inch) coating) of the adhesive cracking at a 0.56 cm (0.22 inch) wedge opening.

EXAMPLE 2

An accepting portion 11 of the strip material 10 as shown in FIG. 1 was prepared by adding 8.1 parts of ethylene-vinyl acetate copolymer (e.g., Elvax 460 from DuPont); 8.1 parts of polyethylene-methacrylic acid copolymer having a 93° C. ring melt index ("Polyeth" 70055 from Gulf Chemical); and 16.2 parts of paraffin wax (e.g., 4.0 parts of Shellwax 100 and 12.2 parts of Shellwax 200 from Shell Chemical) into 100 parts of toluene. The mixture was heated to 95° C. and stirred gently to effect solution. The solution was coated onto a 0.04 mm (0.0015 in.) thick receiving web 14 of clear polyester by a knife coater set to produce an average dry thickness for the adhesive material 15 of about 1.3 micrometers (0.00005 inch); and the coated solution was dired by forced air at room temperature so that the incompatible polymers solidified into a sponge-like matrix with liquid paraffin wax in its interstices, which paraffin wax then solidified to produce a layer of adhesive material 15 with the desired properties.

The friable donor layer 18 for the transfer portion 12 of the strip material 10 was prepared in the same manner described in Example 1 above. The two coated materials were then slit and placed with the donor and adhesive layers 18 and 15 in face to face contact, and when the composite material 10 thus formed was then selectively irradiated and the donor and receiving webs 17 and 14 were then separated in the manner described above, the entire thickness of the donor layer 18 in the irradiated areas of the strip material 10 transferred to the layer of adhesive material 15 on the receiving web 14.

Graphics 37 formed on the accepting tape 11 could be transferred to a fibrous substrate such as paper, illustration board, glass or plastic film by positioning the graphics 37 adjacent the substrate and applying rubbing pressure to the surface of the receiving web 14 opposite the graphics 37 with a stylus; however the receiving web 14 had to be peeled from over the graphics 37 as they transferred to prevent the graphics 37 from readhearing to the receiving web 14. The light reflecting of the graphics as viewed through the receiving web 14 visibly decreased as the rubbing pressure was applied, indicating when the adhesive layer 15 over the graphic had fractured and released from the receiving web 14. As the receiving web 14 was peeled away from the transferred graphics 37, it carried with it the adhesive layer 15 except in the areas from which the graphics 37 has been transferred where the adhesive layer 15 was missing. The missing portions of the adhesive layer 15 were visibly apparent on and around the transferred graphics 37 as a waxy surface that had a low luster. The transferred graphics 37 had sharp, clean edges and were firmly adhered to the substrate so that the substrate could be handled like normal printed matter without releasing the graphics 37.

I claim:

1. In a composite material for forming graphics such as letters, numbers, symbols or pictures in accordance with patterns of heating, the composite material comprising a donor web; a frangible donor layer releasably adhered to a surface of the donor web; a receiving web; and a layer of latent adhesive material adhered to the receiving web and facing the donor layer, which adhesive material is nontacky at normal room temperature, but is selectively softened and activated when heated to a temperature range somewhat above normal room temperature and then adheres to the donor layer so that upon separation of the receiving and donor webs, portions of the donor layer are carried with the latent adhesive material in heated areas to provide graphics, said frangible donor layer being microgranular in nature to afford separating lines for said portions generally normal to the surface of the donor web, which separating lines closely conform to the periphery of the heated areas; the improvement wherein:

said frangible donor layer is somewhat adhesive and said layer of latent adhesive material is sufficiently weak and frangible that when graphic-shaped portions of said donor layer adhered to said latent adhesive material are pressed against a substrate by rubbing pressure alone in the absence of heat, which pressure is applied through the receiving web, the latent adhesive material will tear around the graphic-shaped portions and separate from the receiving web over the graphic-shaped portions so that the graphic-shaped portions will transfer and adhere to the substrate.

2. A composite material according to claim 1, wherein said layer of latent adhesive material is brittle.

3. A composite material according to claim 2, wherein said layer of latent adhesive material is a novolac epoxy resin.

4. A composite material according to claim 2, wherein said layer of latent adhesive material is a cresol novolac epoxy resin having a thickness of between about 0.0076 mm and 0.0132 mm.

5. A composite material according to claim 1, wherein said layer of latent adhesive material comprises a sponge-like copolymer matrix having paraffin wax in its interstices.

6. A composite material according to claim 5, wherein said copolymer matrix comprises a polyethylene-methacrylic acid copolymer and an ethylene-vinyl acetate copolymer.

7. A composite material according to claim 1, wherein said frangible donor layer comprises microgranules fused to each other and having interstices containing pigment and liquid.

8. A method of forming graphics such as letters, numbers, symbols or pictures and applying the graphics to a substrate comprising the steps of:

providing an accepting portion comprising a receiving web, and a layer of latent adhesive material, which adhesive material is brittle and nontacky at normal room temperature, but is softened and activated when heated to a temperature range slightly above normal room temperature;

providing a transfer portion comprising a donor web, and a frangible, slightly adhesive donor layer releasably adhered to a surface of said donor web;

pressing said layers in face-to-face contact to provide a composite material;

heating the composite material selectively in a graphic pattern above the softening range of said adhesive material so that the layer of adhesive material selectively softens and adheres to the donor layer;

separating the accepting portion and donor web to carry portions of the donor layer to the accepting portion in the configuration of graphics corresponding to the pattern of heating, the donor layer being microgranular in nature to afford separating lines for the portions generally normal to the surface of the donor web, which separating lines closely conform to the periphery of the pattern of heating;

positioning the separated accepting portion with its portions of the donor layer in contact with the substrate;

pressing the positioned portions of the donor layer against the substrate through the accepting web using pressure alone in the absence of heat to tear the latent adhesive material around the portions, separate the adhesive material over the portions from the receiving web and adhere the portions to the substrate; and removing the accepting portion.

9. A method of forming graphics according to claim 8 wherein said layer of latent adhesive material is brittle and said pressing step includes the step of stretching the receiving web over the graphics to effect said tearing and separating of the layer of latent adhesive material.

* * * * *